United States Patent [19]

Reitter et al.

[11] Patent Number: 4,909,061

[45] Date of Patent: Mar. 20, 1990

[54] DRAWING TOOL

[75] Inventors: Erhardt Reitter, Sulzfeld; Karl Hehl, Arthur-Hehl-Strasse 32, D-7298 Lossburg 1; Herbert Kraibühler, Lossburg, all of Fed. Rep. of Germany

[73] Assignee: Karl Hehl, Lossburg, Fed. Rep. of Germany

[21] Appl. No.: 321,773

[22] Filed: Mar. 10, 1989

[30] Foreign Application Priority Data

Mar. 12, 1988 [DE] Fed. Rep. of Germany ..... 3808262

[51] Int. Cl.[4] ..... B21D 22/22

[52] U.S. Cl. ..... 72/334; 72/351; 72/347

[58] Field of Search ..... 72/334, 347, 350, 351, 72/417; 267/119

[56] References Cited

U.S. PATENT DOCUMENTS

| | | | |
|---|---|---|---|
| 1,967,245 | 7/1934 | Hothersall | 72/351 |
| 2,609,775 | 9/1952 | Gaudreau . | |
| 3,372,569 | 3/1968 | Bozek | 72/334 |
| 4,796,453 | 1/1989 | Reitter . | |

FOREIGN PATENT DOCUMENTS

| | | |
|---|---|---|
| 132028 | 4/1949 | Australia . |
| 3603107 | 8/1987 | Fed. Rep. of Germany . |

*Primary Examiner*—Lowell A. Larson
*Attorney, Agent, or Firm*—Spencer & Frank

[57] ABSTRACT

The drawing tool comprises a hydraulic element for deriving from the movement of the blank holder a simultaneous, oppositely directed movement of the drawing punch. The hydraulic element comprises a centrally disposed working piston, an annular piston, which surrounds that working piston, and a cylinder, which surrounds the annular piston. The working piston and the annular piston are adapted to be supplied with pressure fluid from first and second cylinder chambers which are hydraulically separated from each other and which are adapted to communicate with each other under the control of at least two alternative flow paths, which differ in hydraulic design so that they cause pressure changes on different pressure levels to be effected in the second cylinder chamber. A pressure detector detects the pressure of the fluid in the cylinder chambers and enables an alternative flow path in response to a rise of the pressure above a predetermined limit. As a result, a low-cost, compact tool has been provided, which can be used to make even parts which can be drawn only with great difficulty owing to their desired final shape and/or the material from which they are made.

12 Claims, 8 Drawing Sheets

DRAWING TOOL

BACKGROUND OF THE INVENTION

1. Field of the Invention

This invention relates to a drawing tool for deforming preferably planar sheet metal elements, comprising a drawing die, which is operable by an external force, a blank holder, which is movable in unison with the drawing die, a drawing punch, which is adapted to be forced into the drawing die so as to deform the blank, and a hydraulic element for deriving from the movement of the die and blank and the holder a simultaneous, opposite movement that is imparted to the drawing punch, which hydraulic element comprises a centrally disposed, differential working piston, an annular piston, which surrounds said working piston, and a cylinder housing, which surrounds the annular piston, wherein the annular piston is indirectly operable by the external force and adapted to be supported by the fluid in a cylinder chamber and adapted to be supplied with pressure fluid, and the working piston is adapted to be supplied with pressure fluid at both ends and is adapted to be displaced by the pressure fluid which is displaced out of the cylinder chamber by the annular piston during the drawing operation.

2. Description of the Prior Art

In a known drawing tool of that kind the drawing operation is effected by a drawing movement of the externally actuated drawing die and an oppositely directed drawing movement which is performed by the drawing punch at the same time because the working piston is operated to move opposite to the die and blank holder by the pressure fluid that is displaced by the annular piston. A common cylinder chamber is provided for the annular piston and the working piston. After the drawing operation the drawing tool is reset to its initial position by pressure applied to a differential surface area of the working piston. Such a drawing tool has been disclosed in U.S. Pat. No. 4,796,453, the disclosure of which is incorporated herein by reference. Other prior art is apparent from U.S. Pat. No. 2,609,775 and from Australian Patent Publication No. 132,028.

In a drawing tool of a different kind it is known to change the drawing force and the blank-holding force by means of hydraulic controls in that pressure fluid is drained from the respective cylinder chambers into a reservoir. Those volumes of pressure fluid which are required to be contained in the respective cylinder chambers for the conventional drawing operation can be re-established by a supply of fluid from a pressure accumulator. Because the drawing die cushion is relatively large in that drawing tool, the latter can be used only in large presses (Published German Application No. 3,603,107).

SUMMARY OF THE INVENTION

In view of the prior art outlined hereinbefore it is an object of the invention to provide a drawing tool which is of the kind described first hereinbefore and which is inexpensive and compact and permits the manufacture even of drawn parts which involve extremely great difficulties as regards the final shape and/or the material employed and/or the drawing depth required.

That object is accomplished in accordance with the invention in that the working piston and the annular piston are adapted to be supplied with pressure fluid from respective first and second cylinder chambers, which are hydraulically separated from each other and which are adapted to communicate with each other under the control of at least two alternative flow paths, which differ in hydraulic design to provide a pressure rise to different pressures in the cylinder chambers which are adapted to communicate with each other, a pressure detector is provided, which detects the pressure of the fluid in the cylinder chambers and generates a control pulse in response to a pressure rise above a preset limit, and the alternative flow paths are adapted to be enabled in response to the control pulses generated by the pressure detector.

In such a drawing tool the hydraulic separation between the first and second cylinder chambers which adjoin the annular piston and the working piston, respectively, offers numerous possibilities of influencing the performance of the drawing operation. On the other hand, the compactness which is due to the provision of a plurality of coaxially interfitting pistons (central piston 10c, working piston 12; annular piston 13) can generally be retained. The drawing die, the blank holder and/or the drawing punch can be replaced in a simple manner for an adaptation to different parts to be drawn. In the drawing tool in accordance with the invention the drawing die and the drawing punch perform mutually opposite movements during the drawing operation and that operation can be adapted in each case to the requirements imposed by drawing technology in that a desirable flow path is enabled in response to the detected pressure. Each change of the flow path is initiated by an undesired condition, such as an incipient risk of a tearing of the workpiece or an insufficient drawing velocity, and will enable or disable suitable hydraulic means. Changes of the blank-holding force, the drawing force and the drawing velocity may be effected in alternation during such a drawing operation in order to achieve a drawing operation which is quick and energy-saving. Besides, it is possible to effect a controlled draining of fluid from the cylinder chambers of the hydraulic element to a pressure accumulator or to a fluid reservoir and a supply of pressure fluid from a pressure accumulator to the cylinder chambers so that further possibilities of controlling the drawing operation may be opened. For instance, a drawing operation or a timed portion thereof may be performed while the drawing die or the drawing punch is held in position. On the other hand, relatively simple parts can be made without a change of the flow path and at a relatively high rate if a flow path having the lowest possible resistance to flow (first flow path) is used. It is apparent that the energy-saving process in which the drawing die and the drawing punch move in mutually opposite directions can be performed almost throughout the drawing operation. Only for a drawing of intricate parts or during critical phases of a drawing operation may the deformation be effected by a movement only of the drawing die whereas the drawing punch is held in position or by a movement only of the drawing punch whereas the drawing die is held in position.

In accordance with a preferred feature the first and second cylinder chambers are defined by a bottom of a cylinder housing and are hydraulically separated from each other by a tubular partition, which protrudes from that bottom, the annular piston is guided by the cylinder of the cylinder housing and is guided on the working piston by a radial flange, which extends across the tubular partition, and the inside peripheral surface of the annular piston is spaced from the outside peripheral surface of the tubular partition. In such a drawing tool the hydraulic element is highly compact in spite of the separation of the first and second cylinder chambers adjoining the working and annular pistons, respectively. As a result, the drawing tool can be used in different presses for exerting the external actuating force, particularly in small presses.

In accordance with a further feature of the invention the working piston is adapted to be supplied with pressure fluid at its rear end from the second cylinder chamber and is adapted to be supplied with pressure fluid in an opposite direction from a third cylinder chamber which is disposed in a central opening of the pot-shaped working piston and is defined by a central piston, which is anchored in the bottom of the cylinder housing, and a ring, which is connected to the working piston, and the rear or second cylinder chamber communicates with a fourth cylinder chamber, which is defined by the bottom of the working piston and by the central piston. Such a hydraulic element can be made relatively easily and when the drawing operation has been completed the working piston can be returned to its initial position by a supply of fluid from the third cylinder chamber, which is defined by the central piston. During the drawing operation the oil which is necessarily displaced from said third cylinder chamber can be supplied to the second cylinder chamber on the rear of the working piston so that the drawing operation will be accelerated.

In accordance with a preferred feature the first flow path comprises a line that includes a directional valve and a pressure detector, the second flow path comprises a line which includes a controllable pressure relief valve, which is adjustable to different pressure limits and is preceded by a check valve, and the third flow path comprises a line that includes a directional valve, a throttle valve, and a piston-type pressure accumulator, which acts as a hydraulic pressure transformer. In that case the first flow path (line 20) can be enabled for the making of relatively simple parts. The pressure relief valve 36 in the second flow path (line 20*a*) can be adjusted to a pressure limit which corresponds to a blank-holding force that is in accordance with the requirements imposed by drawing technology before the beginning and during the drawing operation, provided that the optimum initial blank-holding force has empirically been determined before. When the third flow path (line 20*b*) has been enabled, the pressure in the hydraulic system will be reduced by the pressure transformer when there is a risk of a tearing of the part that is being drawn. The change of the flow path in dependence on the requirements imposed by drawing technology will eliminate any risk of tearing and will result in an optimum drawing operation regarding energy saving and drawing velocity. The pressure limits and flow areas which are to be preadjusted at the pressure relief valve and at the throttle valve will usually be empirically determined before.

In accordance with a preferred feature, the velocity of the drawing operation is increased in that the fluid contained in the third cylinder chamber that is defined by the ring and the central piston is adapted to be fed via a line that incorporates a directional valve to the second cylinder chamber at the rear of the working piston and when it is desired to reset the drawing tool to its initial position the then empty third cylinder chamber is adapted to be refilled from a pressure accumulator. This resetting will result in a displacement of fluid in a volume that corresponds to the volume of the said cylinder chamber to a fluid reservoir. In that case the velocity of the drawing operation can be increased in conjunction with a suitable adaptation of the blank-holding force.

In accordance with a preferred feature, the output cylinder chamber of the piston-type pressure accumulator is adapted to be connected via a line that incorporates a directional valve to a main pressure accumulator, which is adapted to be connected to all cylinder chambers of the hydraulic element and which is adapted to be recharged by a feed pump with pressure fluid from the fluid reservoir. In that case the third flow path can be connected to the main pressure accumulator so that the drawing operation can be performed while the working piston is held in position. If the third flow path is opened only in part, the pressure in the hydraulic system will be reduced for a controlled time.

In accordance with a preferred feature, the working piston is operable by a supply of fluid from a pressure source whereas the annular piston is held in position and the fluid which is displaced from the third cylinder chamber is adapted to be drained to the fluid reservoir via a directional valve. In that case the drawing operation can be performed while the annular piston is held in position.

In accordance with a preferred feature the directional valve and the throttle valve in the line which constitutes the third flow path are adapted to be by-passed by a by-pass line, which contains a check valve for permitting a flow in the direction of flow in the third flow path in response to a pressure rise above a predetermined value. In that case the charges of fluid in the cylinder chambers of the hydraulic element can exactly be reproduced when fluid has previously been drained from said cylinder chambers to the input accumulator chamber of the piston-type pressure accumulator.

In accordance with a preferred feature, a severing cutter is provided, which is mounted for a limited displacement in the blank holder and serves to sever the remaining blank from the edge of the drawn part. Those parts which are moved during the severing operation, namely, the drawing die, the blank holder and the annular piston, are adapted to be arrested in response to the pressure drop which results from the elimination of the resistance of the blank to the severing movement. In response to that pressure drop the flow of fluid from the cylinder chamber adjoining the annular piston is throttled. Specifically, the flow of fluid from the cylinder chamber adjoining the annular piston is adapted to be throttled by means of the throttle valve that is included in the third flow path in response to the pressure drop that results from the elimination of the resistance of the blank to the severing movement when the directional valve (33) is closed and the directional valve (25) is open. In that case an over-stressing of the drawing tool during the severing of the remainder of the blank from the edge of the drawn part will be avoided.

BRIEF DESCRIPTION OF THE DRAWING

FIGS. 1, 2 and 4 show the drawing tool at the start of the drawing operation and FIGS. 3 and 5 to 8 show the drawing tool at the end of the drawing operation.

DETAILED DESCRIPTION OF THE PREFERRED EMBODIMENT

Figure 1:
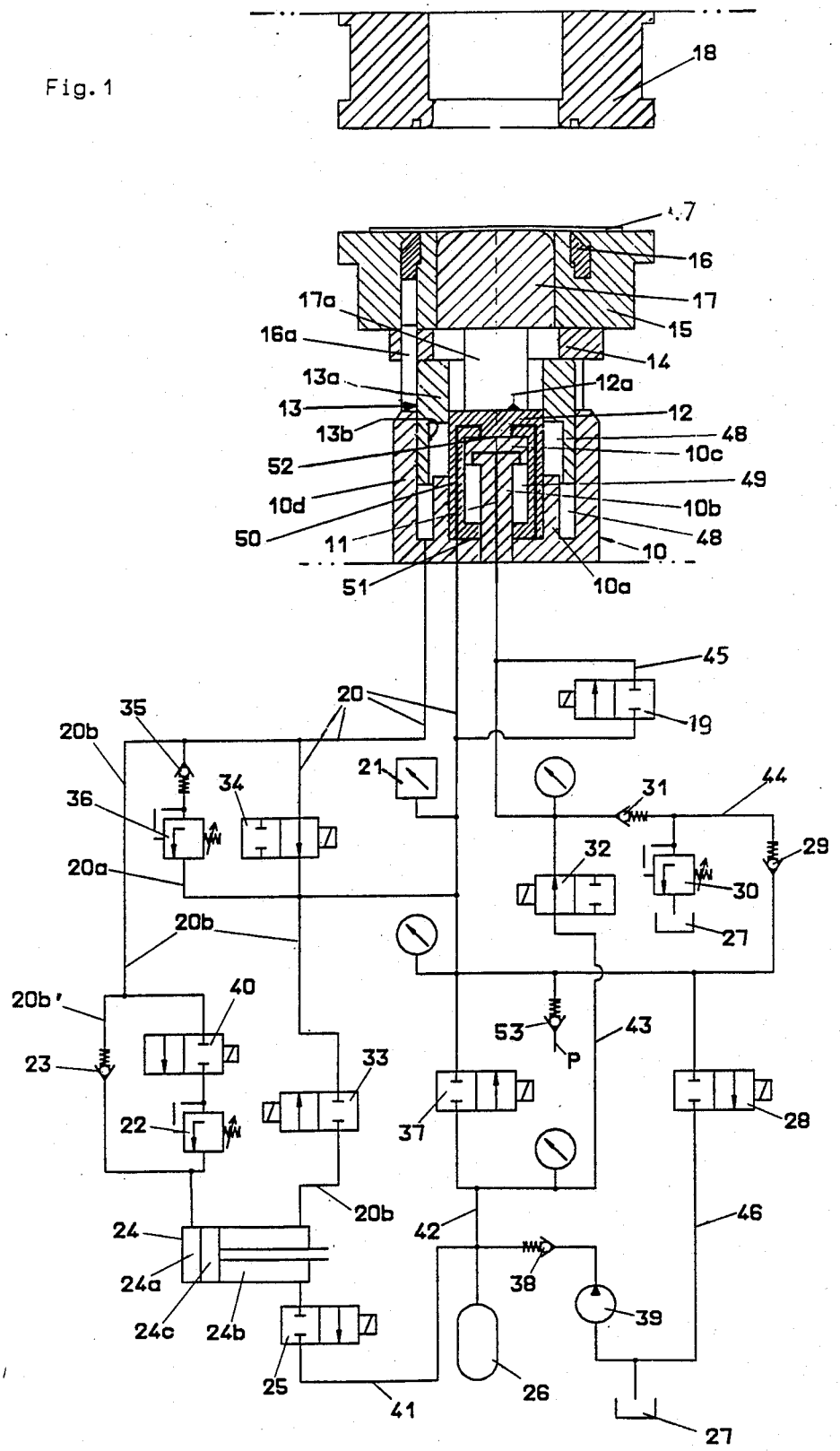
FIG. 1 is a diagrammatic sectional view taken on a plane which contains the axis of symmetry of the drawing tool and shows that tool and the associated hydraulic control means.

The invention will now be described more in detail with reference to the diagrammatic drawing.

The present drawing tool is used to deform preferably planar sheet metal blanks, e.g., to form containers, pots, kitchen sinks and the like. For such deformation, an external actuating force A is exerted on the drawing tool, usually by a hydraulic press having an upper cross head which actuates the drawing die 18 of the drawing tool. During the deforming operation a blank holder 15 is moved in unison with the drawing die. Before the beginning of the drawing operation a blank 47 is clamped between the drawing die and the blank holder. A drawing punch 17, which is coaxially disposed in the blank holder, is coaxially forced into the drawing die 18 in order to deform the blank 47. The drawing tool comprises a hydraulic element H, by which the movement of the drawing die 18, the blank holder 15 and the blank 47 can be utilized to impart a simultaneous opposite movement to the drawing punch 17. The hydraulic element H comprises a central working piston 12, an annular piston 13, which surrounds the working piston 12, and a cylinder **10*d*, which surrounds the annular piston and is incorporated in a cylinder housing 10 of the hydraulic element H. The annular piston 13 is adapted to be indirectly actuated by the external force A and is adapted to be supported by a fluid which is contained in a first cylinder chamber 48. The working piston 12 consists of a differential piston and is adapted to be supplied with pressure fluid at both ends. The fluid which is displaced out of the first cylinder chamber 48 by the annular piston 13 moving in a first direction during the drawing operation may be used to displace the working piston in an opposite, second direction at least during part of the drawing operation. The bottom of the cylinder housing 10 defines cylinder chambers 51, 52 and 48, which are hydraulically separated from each other by a tubular partition 10*a*, which protrudes from the bottom of the cylinder housing 10. The annular piston 13 is guided by the cylinder 10*d* of the cylinder housing 10 and is guided on the working piston 12 by means of a radial flange 13*a*, which bridges the tubular partition 10. The inside peripheral surface 13*b* of the annular piston 13 is spaced from the outside peripheral surface of the tubular partion 10*a*. The working piston 12 is adapted to be supplied at its rear end with pressure fluid from the second cylinder chamber 51 and is adapted to be supplied in the opposite direction with pressure fluid from a third cylinder chamber 49. The third cylinder chamber 49 is disposed in a central cavity of the pot-shaped working piston 12 and is defined by a central piston 10*c* that is anchored in the bottom of the cylinder housing 10 and by a ring 12*b*, which is screwed to the working piston 12. The ring 12*b* surrounds and is in sealing contact with the stem 10*b* of the central stationary piston 10*c*. The second cylinder chamber 51 communicates with the fourth cylinder chamber 52, which is defined by the bottom 12*a* of the working piston 12 and by the central piston 10*c*. As is apparent from FIG. 1 the drawing punch 17 is connected by a cylindrical connector 17*a* to the working piston 12. An adapter ring 14 provided between the blank holder 15 and the top edge of the annular piston 13 serves to transmit an actuating force from the blank holder 15 to the annular piston 13. An annular cutter 16 is mounted on the blank holder 15 for a limited displacement and cooperates with stationary stops 16*a* for severing the remainder of the blank from the edge of the part which has been drawn. The stationary stops 16*a* are supported on the end rim of the cylinder 10*d* of the cylinder housing 10** and during the descent of the blank holder extend into registering bores formed in the blank holder.

The working piston 12 and the annular piston 17 are adapted to be supplied with pressure fluid via the cylinder chambers 51, 52, on the one hand, and 48, on the other hand, which are hydraulically separated from each other. In the illustrative embodiment shown on the drawing said cylinder chambers are adapted to be interconnected by three alternative flow paths, which have different hydraulic designs. The first flow path includes the line 20. The second flow path includes the line **20*a*. The third flow path includes the line 20*b***.

Because the alternative flow paths differ in hydraulic design, they result in different pressures in the second and fourth cylinder chambers 51, 52, which communicate with each other via the communicating passage 50, and in the first cylinder chamber 48. A change from one flow path to another can be initiated by a pressure detector 21, which is adapted to detect the pressure of the pressure fluid in the cylinder chambers 51, 52; and 48, which communicate with each other, and which delivers control pulses when said pressure rises above preset limits. The line 20 which is incorporated in the first flow path contains a two-way valve 34 and is connected to the pressure detector 21. The line **20*a* which is included in the second flow path contains a controllable pressure relief valve 36, which is adapted to be set to different pressure limits and which is preceded by a check valve 35. The line 20*b* which is included in the third flow path contains a two-way valve 40, a throttle valve 22 and a piston-type accumulator 24, which constitutes a hydraulic pressure transformer. The fluid which is supplied to the cylinder chambers 51, 52 through any of the three alternative flow paths during the drawing operation acts on the working piston 12 on a surface area which exceeds the cross-sectional area of the bottom 12*a* of that piston. As a result, the working piston acts as a pressure transformer. This is possible because the stationary piston 10*c* protrudes radially beyond its stem 10*b*** so that the surface supplied with pressure fluid is larger. Owing to that design the external force A can be transformed into a larger force that is exerted by the working piston whereas the drawing stroke is decreased.

The velocity of the drawing operation can be increased in that fluid from the third cylinder chamber 49 that is defined by the ring **12*b* and the central piston 10*c* is supplied to the second cylinder chamber 51 on the rear of the working piston 12. As a result, the fluid which is displaced from the third cylinder chamber 49 during the drawing operation flows through the then open two-way valve 19, the passage 11 and the line 45 into the second and fourth cylinder chambers 51, 52. In order to reset the drawing tool to its initial position after the drawing operation the then empty third cylinder chamber 49 is refilled from a main pressure accumulator 26. During that resetting, pressure fluid having a volume which is equal to the volume of the third cylinder chamber 49 can be displaced from the cylinder chambers 50, 51; 48 into the fluid reservoir 27. The right-hand cylinder chamber 24*b* of the piston-type accumulator 24 is adapted to be connected by a line 41, which incorporates a two-way valve 25, to the main pressure accumulator 26, which can be connected to all cylinder chambers of the hydraulic element for recharging them or for relieving them from pressure. The pressure accumulator 26 is adapted to be recharged from the fluid reservoir 27 by means of a feed pump 39**.

When the annular piston 13 is held in position because the external force A is not exerted, the working piston 12 is operable by pressure fluid from a pressure source P. In that case the fluid which is displaced from the third cylinder chamber 49 is drained through a two-way valve 28 to the fluid reservoir 27. Alternatively, the fluid may be discharged through a valve 30, which opens when the pressure rises above an upper limit.

The two-way valve 40 and the throttle valve 22 which are contained in the line **20*b* that is included in the third flow path are adapted to be by-passed by a by-pass line 20*b*', which contains a check valve 23, which in response to a predetermined pressure permits a flow in the direction of flow in the third flow path. The mass which is moved as the remainder of the blank is severed from the edge of the drawn part consists in the illustrative embodiment of the drawing die 18, the blank holder 15, the adapter ring 14 and the annular piston 13. In response to the pressure drop that results from the elimination of the resistance of the blank to the severing operation that mass can be arrested in that the draining of the fluid from the first cylinder chamber 48 is throttled. This is effected by means of the throttle valve 22, which is contained in the line 20*b* that is included in the third flow path. The fluid will flow through the piston-type pressure accumulator 24 into the main pressure accumulator 26 when the two-way valve 33 is closed and the two-way valve 25** is open.

In FIG. 1 the drawing tool is shown in an inoperative condition together with the entire associated hydraulic element and the inserted blank.

FIGS. 2 to 8 may be referred to for an explanation of various process sequences performed in the operation of the drawing tool in view of different requirements for the drawing operation. Those lines and chambers which are flown through in case of a given mode of operation are emphasized by relatively thick lines. All means which are not used in a given mode so that no pressure is applied to them have been omitted.

Figure 2:
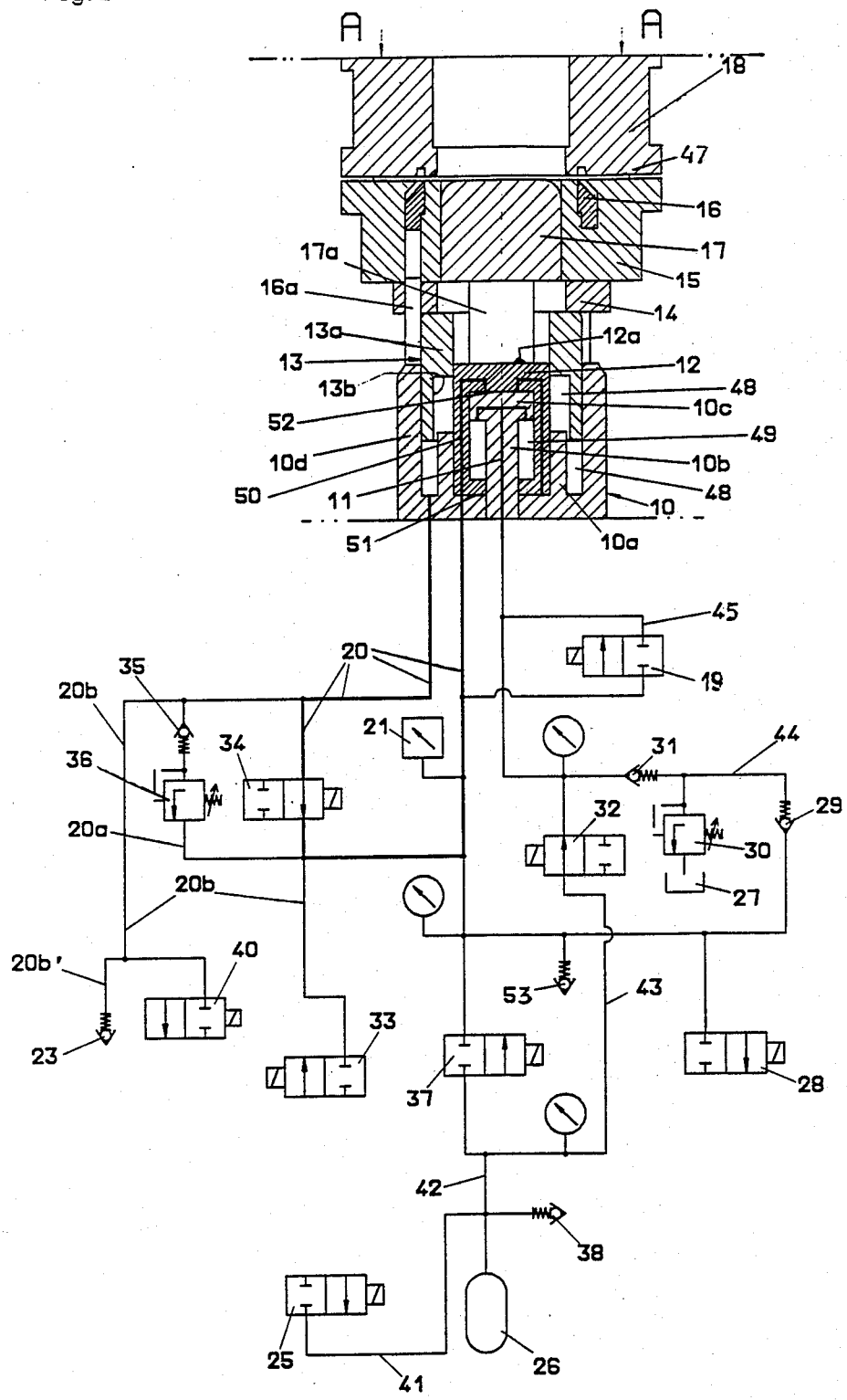
FIGS. 2 to 8 are views which are similar to FIG. 1 and illustrate the drawing tool in different operating positions and during different modes of operation.

Mode of operation illustrated in FIG. 2 the first flow path is enabled for a making of simple drawn parts at a relatively high rate. During the drawing operation, pressure fluid flows from the first cylinder chamber 48 through the line 20, which includes the two-way valve 34, into the second cylinder chamber 51 and flows also through the communicating passage 50 into the fourth cylinder chamber 52.

Figure 3:
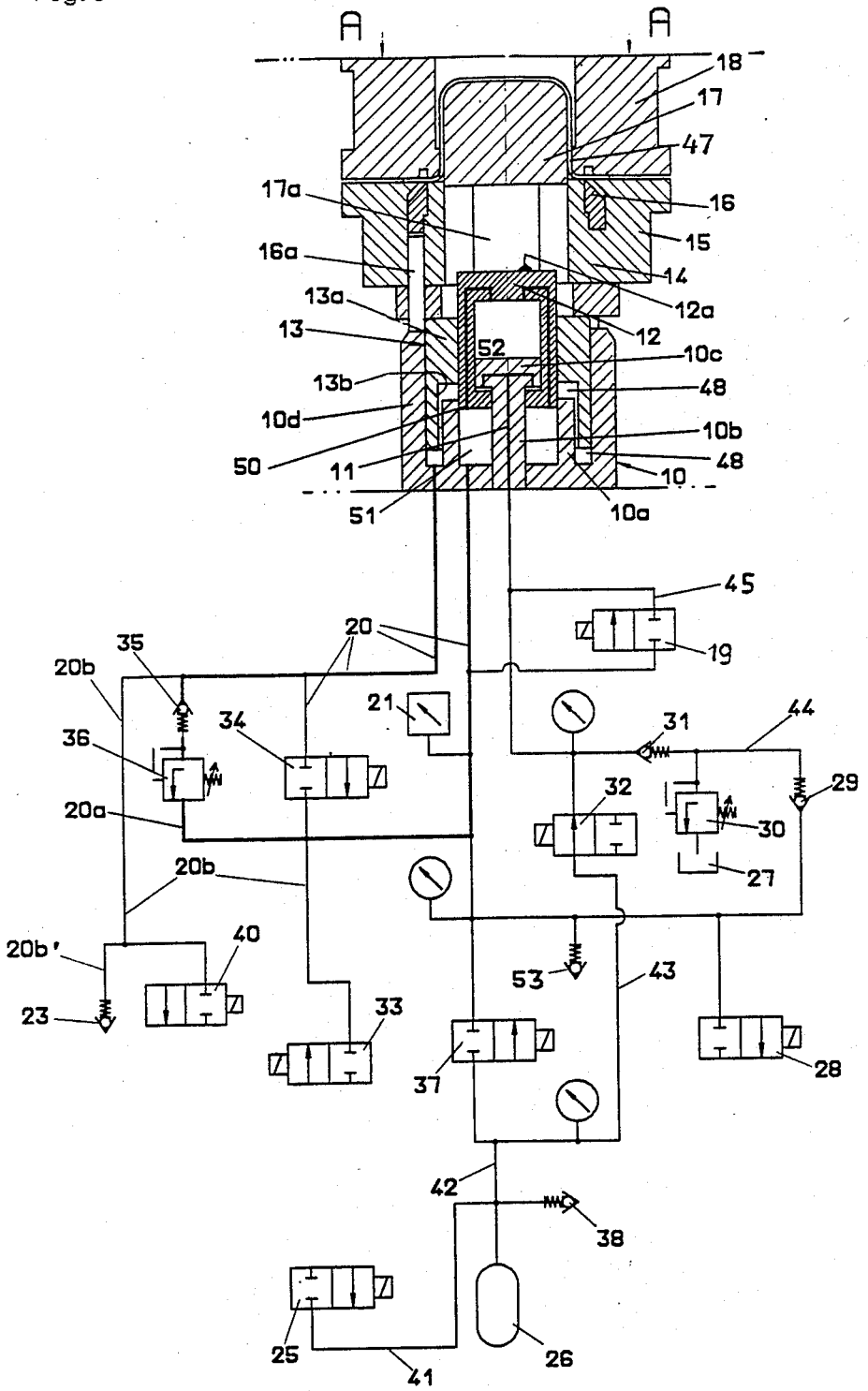

In the position shown in FIG. 3, the second flow path is enabled so that the fluid is displaced from the first cylinder chamber 48 through a part of the line 20 of the first flow path, a check valve 35 and an adjustable pressure relief valve 36 in a line **20*a* into the second and fourth cylinder chambers 51, 52 to displace the working piston 12. The use of that flow path will make sense if the blank-holding force is to be set to a proper value before the drawing operation begins and/or if the blank-holding force should be controlled during the drawing operation. The drawing operation will not begin until the blank-holding force, i.e., the pressure in the first cylinder chamber 48, rises above the pressure limit that has been adjusted at the pressure relief valve 36. That pressure limit is adapted to be set and/or changed in dependence on the pressure that is detected by the pressure detector 21**. As a result, the blank-holding force can be adapted to the instantaneous requirements imposed by drawing technology during the drawing operation.

Figure 4:
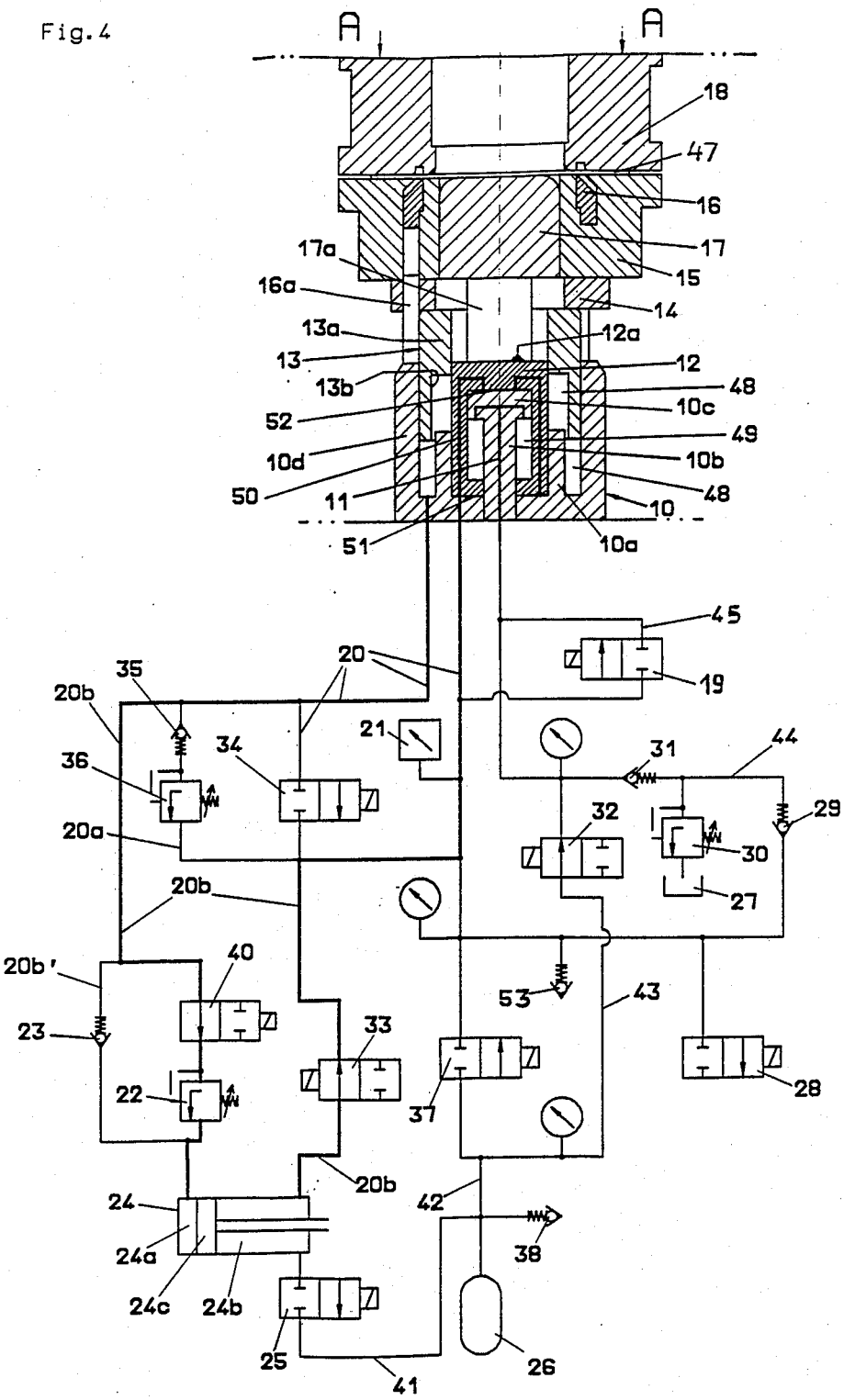

In accordance with FIG. 4, the third flow path is enabled so that the fluid which comes from the first cylinder chamber 48 and is forced through a part of the line 20 that belongs to the first flow path and then through line **20*b*, through a two-way valve 40, a throttle valve 22, a piston-type pressure accumulator 24 and another directional valve 33 into the cylinder chambers 51, 52 to displace the working piston 12. As is apparent from FIG. 4 the piston-type pressure accumulator 24 constitutes a pressure transformer so that when the third flow path is enabled the pressure in the hydraulic system will be reduced and the velocity of the drawing operation will be correspondingly reduced in response to a pressure rise above an upper limit which has empirically been determined before. Regardless of whether the pressure fluid is supplied to the second and fourth cylinder chambers 51, 52 via the first, second or third flow path or from the pressure source P (FIG. 6), the fluid which is displaced from the third cylinder chamber 49** during the drawing operation can be drained along different routes in dependence on the requirements to be met from the aspect of drawing technology.

1. When the drawing operation is to be performed at a higher velocity, the fluid may be supplied to the second and fourth cylinder chambers 51, 52 via the directional valve 19 in line 45. In that case the drawing tool will be reset after the drawing operation in a manner which will be explained more in detail hereinafter. During that resetting, fluid will be displaced from the second and fourth cylinder chambers 51, 52 to the fluid reservoir 27 and the volume of the fluid thus displaced will equal the volume of the fluid which has previously been supplied to the second and fourth cylinder chambers 51, 52 during the drawing operation. As a result, the fluid flows from said cylinder chambers 51, 52 through a portion of line 20 and the directional valve 28 to the fluid reservoir 27.

2. The fluid which is displaced from the third cylinder chamber 49 during the drawing operation flows through lines 43, 42, 46 and directional valves 32, 37, 28 directly into the fluid reservoir 27.

Figure 8:
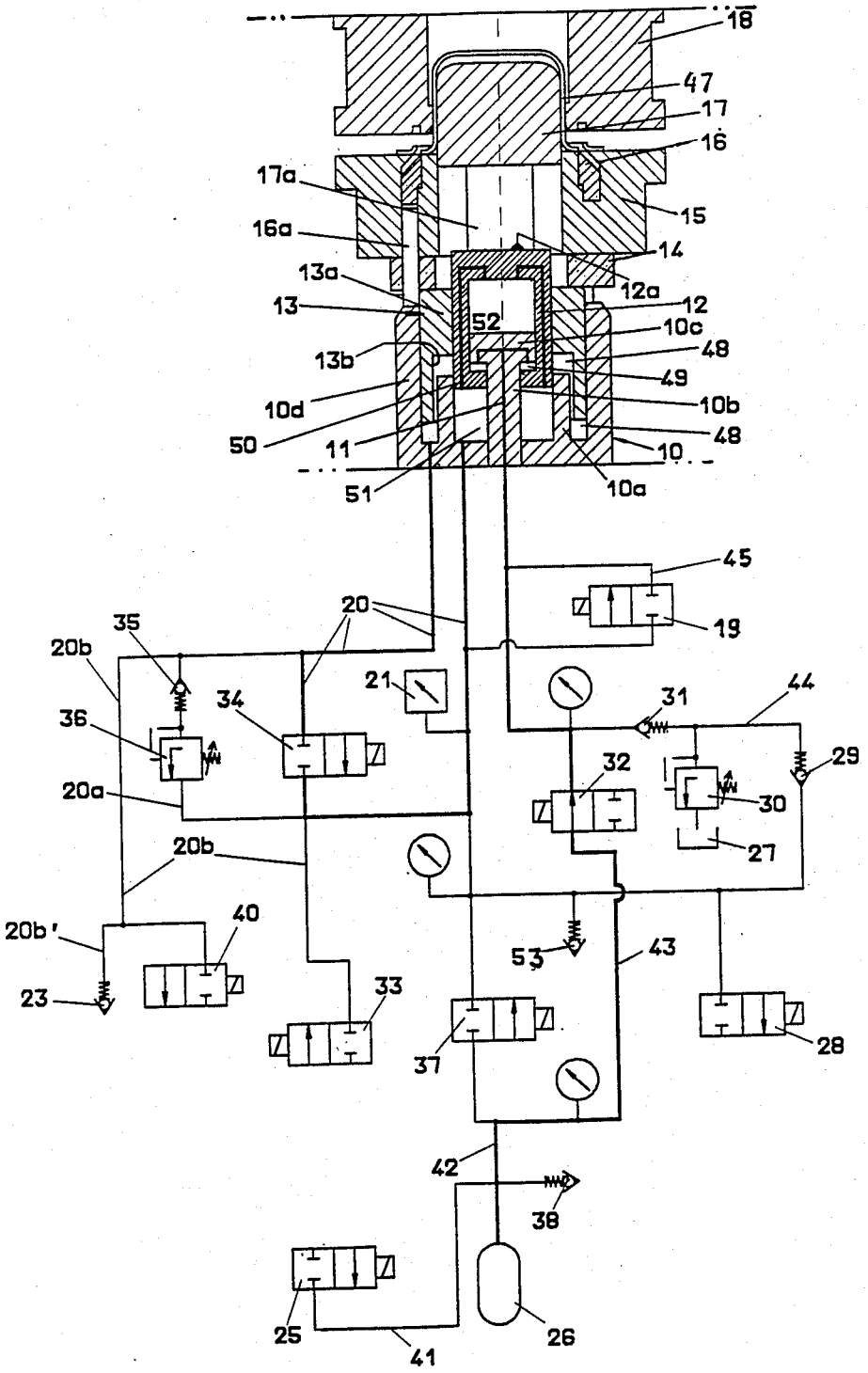

It is shown in FIG. 8 how the drawing tool is reset from its end position assumed after the drawing operation to its initial position. During that process sequence, pressure fluid flows from the main pressure accumulator 26 through an initial portion of a line 42 and through a line 43 and the directional valve 32 and through the passage 11 in the stem **10*b* into the initially empty third cylinder chamber 49, where it displaces the working piston 12 in a direction which is opposite to the direction of its drawing movement. The fluid which is displaced from the second and fourth cylinder chambers 51, 52 during the resetting of the working piston 12 to its initial position may return to the first cylinder chamber 48, e.g., via the first flow path. Attention is directed to the fact that when the fluid has been fed from the third cylinder chamber 49 to the second and fourth cylinder chambers 51, 52 in order to perform the drawing operation at a higher speed, as has been described hereinbefore, it will be necessary during the resetting of the drawing tool to displace fluid from the second and fourth cylinder chambers 51, 52 into the fluid reservoir 27 and the volume of the fluid thus displaced must correspond to the volume of the fluid which has previously been supplied to the second and fourth cylinder chambers 51, 52. As a result, a part of the fluid which is contained in the second and first cylinder chambers 51, 48 and the passage 50**, i.e., in an internal communicating system, will be replaced. Such a partial replacement will be desirable because it will prevent a temperature rise of the fluid in the cylinder chambers above a critical limit and will permit the purity of the fluid to be maintained by a filtering of the fluid which has been withdrawn.

Figure 5:
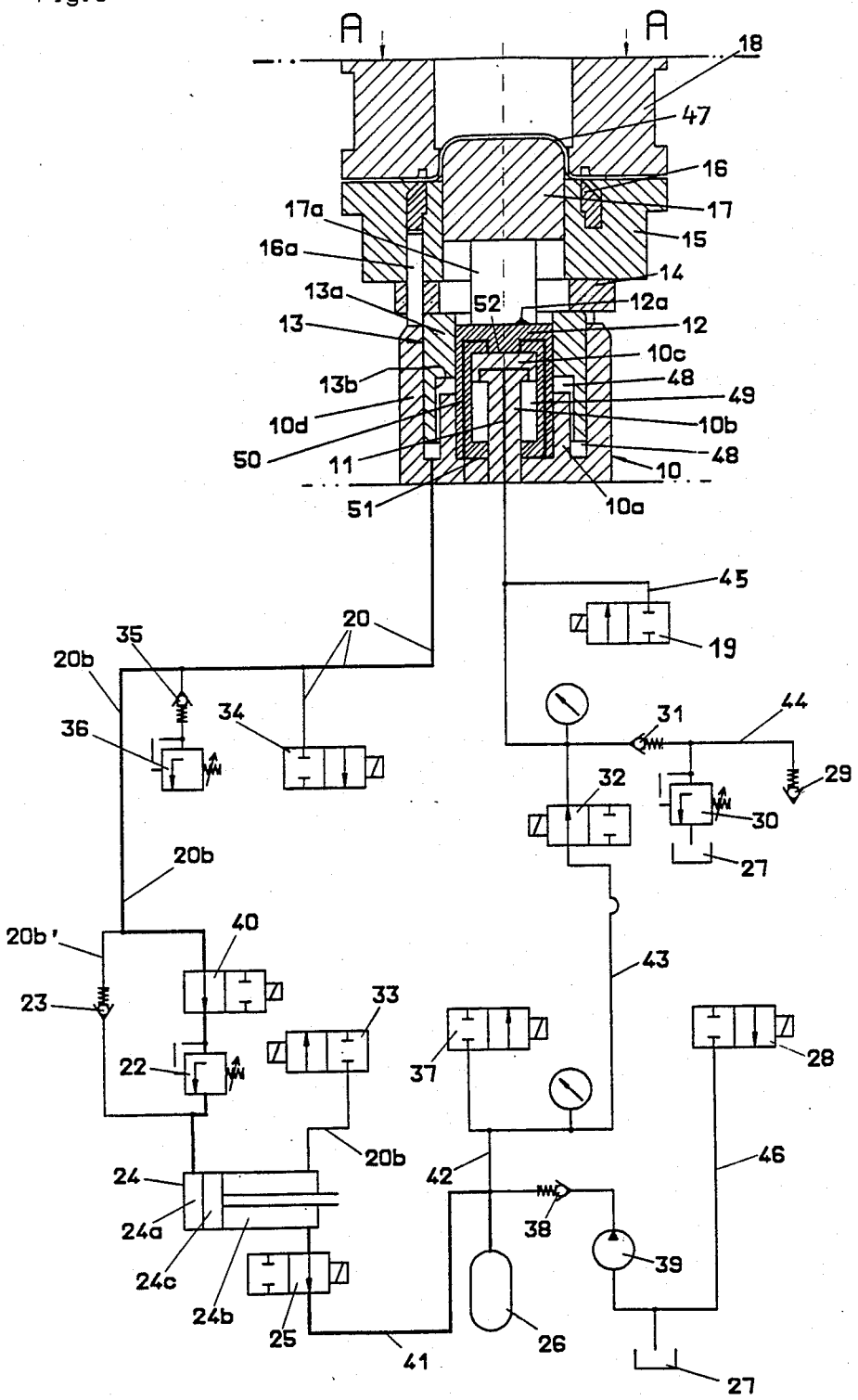
Figure 6:
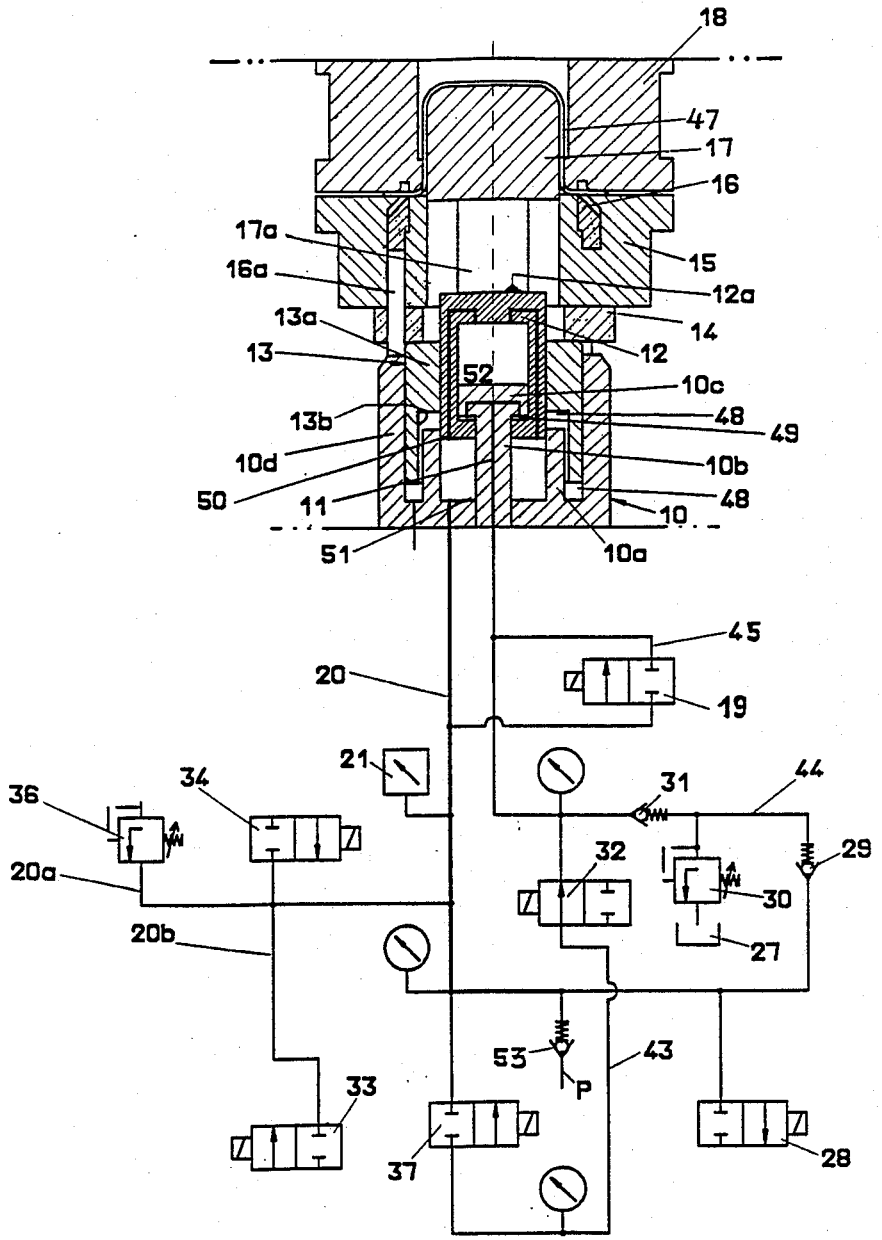

In the process sequences which are illustrated in FIGS. 5 and 6 the drawing punch 17 is held in position (FIG. 5) or the blank holder 15 is held in position during the drawing operation so that the blank holder and the drawing punch do not move in mutually opposite directions. Such a mode of operation may be required in the drawing of certain intricate parts. It may also be possible to adopt such a mode only during a particularly critical part of the entire drawing operation whereas before and after said portion of the drawing operation the first, second or third flow path is used in order to save energy and to perform the drawing operation at a higher velocity or a change between said flow paths may be effected.

In accordance with FIG. 5 the drawing operation effected by the external force A is performed only by the movement of the drawing die 18, blank holder 14, adapter ring 14 and annular piston 13 whereas the working piston 12 is not supplied with pressure fluid. This is ensured in that the fluid that has been displaced from the first cylinder chamber 48 is conducted via line **20*b*, directional valve 40, and throttle valve 22 to the left-hand accumulator chamber 24*a* of the pressure accumulator 24. As a result of that supply of fluid the piston 24*c* is displaced to the right and displaces fluid from the right-hand accumulator chamber 24*b* of the piston-type accumulator. The fluid which has thus been displaced flows through the directional valve 25 and the line 41 into the main pressure accumulator 26, which can be recharged in case of need from the fluid reservoir by the feed pump 39 through the check valve 38. In that mode of operation the first cylinder chamber 48 must be refilled after each drawing operation. This is effected during a resetting operation, in which fluid from the main pressure accumulator 26 is supplied via line 41 and the directional valve 25 into the right-hand accumulator chamber 24*b* of the piston-type pressure accumulator 24. Under the pressure applied by the fluid to the pressure accumulator the piston 24*c* is thus reset to its initial position so that fluid is displaced from the left-hand accumulator chamber 24*a* in a volume which is exactly as large as the volume of the fluid which has previously been supplied to the chamber 24*a* during the drawing operation. In that manner the first cylinder chamber 48 can be refilled during the resetting of the annular piston with fluid having exactly the initial volume of fluid in said chamber 48**.

In the mode of operation illustrated on FIG. 6 the blank holder is held in position during the drawing operation because the external force A is not exerted whereas the working piston 12 and the drawing punch 17 are operated to perform the drawing operation. In that mode, fluid is supplied from a separate fluid source P via a check valve 53 and a portion of the line 20 included in the first flow path into the initially empty second and fourth cylinder chambers 51, 52 in order to displace the working piston 12 in the direction of its drawing movement. The fluid which is thus displaced from the third cylinder chamber 49 flows through the directional valve 32 into the main pressure accumulator 26. As has been described hereinbefore the drawing tool is reset to its initial position by a supply of pressure fluid from the pressure accumulator 26 to the initially empty third cylinder chamber 49.

Figure 7:
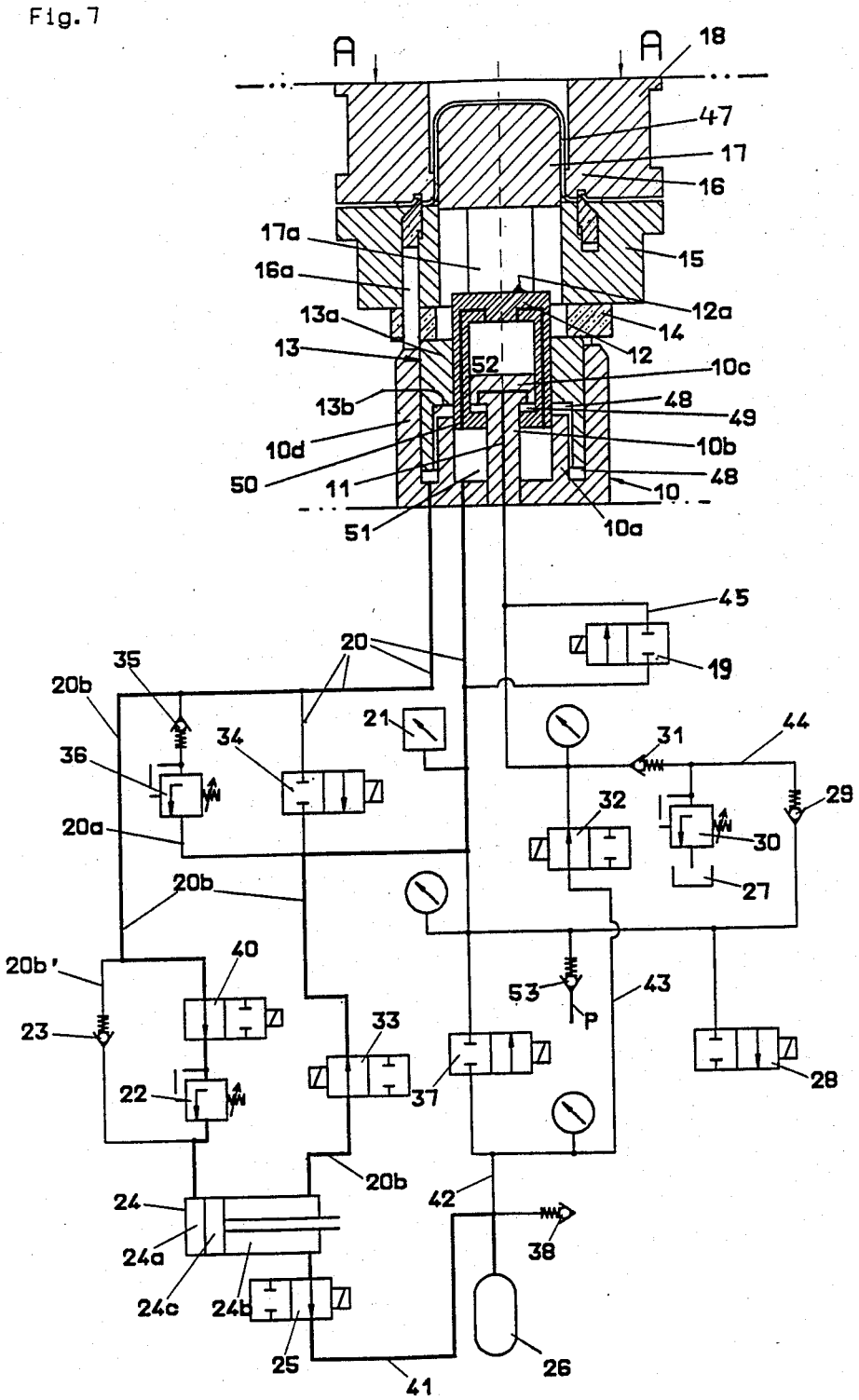

FIG. 7 illustrates how the remainder of the blank 47 is severed from the edge of the completely drawn part. For that severing operation the drawing punch 17 is moved down by means of the working piston 12 and the unit consisting of the drawing die 18, the blank holder 15, the adapter ring 14 and the annular piston 13 is moved down in unison with the drawing punch 17. As a result, the annular cutter 16, which is mounted in the blank holder 15 for a limited displacement, strikes against stop pins **16*a* and is thus caused to perform a small movement relative to the unit 18, 15, 14, 13, 14, 15, 18, i.e., relative to the drawn part and to the blank 47. After the severing operation the hydraulic system is suddenly relieved from the resistance presented by the blank to being severed so that a sudden pressure drop results. In order to prevent a shaking of the drawing tool which may result from that pressure drop, the draining of the fluid from the first cylinder chamber 48 is throttled by the throttle valve 22 in response to the detection of that pressure drop by the pressure detector 21**, as has been described hereinbefore.

In the modes of operation shown in FIGS. 5 and 6 the fluid contained in the first cylinder chamber 48 (FIG. 5) and the fluid contained in the third cylinder chamber 49 (FIG. 6) are displaced into the main pressure accumulator 26 against the pressure prevailing in the latter so that the pressure in the main pressure accumulator 26 is raised to a correspondingly higher level. As a result, the additional energy which has been applied to force the pressure fluid into the main pressure accumulator 26 has been stored in the latter and is available for a succeeding operation, e.g., in a mode as illustrated in FIGS. 7 and 8.

In case of a fault in the actuation of the directional valves 19 and/or 32 and/or 28 a pressure relief valve 30 which is contained in the line 44 will permit a draining of the fluid from the third cylinder chamber 49 into the fluid reservoir 27 so that damage to the hydraulic system will be avoided. The line 44 contains the check valves 31 and 29.

The arrangement in the illustrative embodiment shown on the drawing can greatly be reduced in length in the direction of the axis of symmetry by the omission of the cylindrical connector **17*a* and/or by an omission of the adapter ring 14. In that case it may be desirable so to design the working piston 12 that it constitutes also the drawing punch 17** so that the drawing punch need not consist of a separate part.

An important advantage afforded by the drawing tool in accordance with the invention resides in that the external force A which is exerted on the drawing die 18 in the first direction can be transformed into a much stronger drawing force acting in the opposite, second direction. This may be due to the fact that the pressure fluid that is displaced by the annular piston can act on the working piston 12 on a surface area which is larger than the cross-sectional area of the working piston because the stationary central piston **10*c* radially overlaps the surface on which the working piston 12 can be supplied with pressure fluid from the rear or second cylinder chamber 51. As a result, the surface on which pressure is applied to the working piston 12 comprises the rear end face of the working cylinder and the forward end face of the central piston 10c**. This will ensure that the external force A can be transformed to an oppositely acting drawing force having the same magnitude but acting on a smaller working piston or a smaller drawing tool.

A computer program will first empirically be determined for each part to be drawn in dependence on its desired final shape and its material and the depth to which it is to be drawn. That program will be designed in view of the desire to perform the drawing operation as quickly as possible whereas a tearing of the blank must be avoided. Such tearing of the blank will reliably be avoided because the pressure detector 21 will effect a change to one of the various alternative flow paths so as to reduce the pressure or to reduce the velocity of the drawing operation, e.g., by effecting a change from the second flow path to the first or third flow path or by effecting a partial draining of fluid from the cylinder chamber 48 or 51, 52 or by an elimination of the external force A or a holding of the drawing punch in position. When a pressure drop has been effected and the pressure in the system subsequently rises to the critical limit because the resistance to the drawing movement (resistance to deformation) increases, the hydraulic system will be able to effect a shift from the currently effective flow control to a flow control which will result in a still lower pressure. On the other hand, if the pressure in the system drops below a lower limit that has been adjusted in the pressure detector 21, the system will be shifted to a flow control which will result in a higher pressure and/or in a higher velocity of the drawing movement. The possibility to effect a quick change from one flow control to another will permit a production of drawn parts at a high rate.

Finally the following is remarkable. In the illustrated embodiment shown on the drawings the central stationary piston 10c of the hydraulic element H is surronded by the annular piston 13, which is surrounded by the cylinder housing 10. The cylinder housing may also be formed like a cylinder block surrounding at least two annular pistons, which cylinder block is known from U.S. Pat. No. 4,796,453, especially FIGS. 3 and 4. In each case the interfitting of the stationary piston 10c, the annular piston 13 and the cylinder housing 10 respectively the cylinder block leads to such a compact structure of the drawing tool, that it also may be used in extremly small presses, especially in injection molding machines. For this purpose the hydraulic element H is mounted on a first one of the molding carriers of the injection molding machine. Another unit of the drawing tool, which consists of the drawing die and the blank holder, is mounted on a second one of the mold carriers. Accordingly the drawing tool works at a horizontal axis of drawings.

We claim:

1. In a drawing tool for deforming blanks, comprising a drawing die, which is adapted to be moved by an external force in a first direction, a blank holder, which is adapted to hold a blank across said drawing die and is operatively connected to said drawing die to be movable in unison therewith in said first direction, a drawing punch, which is movable relative to said drawing die in a second direction, which is opposite to said first direction, to force said blank into said drawing die so as to deform said blank in a drawing operation, a hydraulic element for deriving from the movement of said die and holder in said first direction a simultaneous movement imparted to said drawing punch in said second direction, said hydraulic element comprising a centrally disposed, differential working piston connected to said drawing punch, an annular piston surrounding said working piston, and a cylinder housing, which surrounds said working piston and contains a first cylinder chamber which is defined by said annular piston and is adapted to contain fluid for supporting said annular piston at one end thereof, means for supplying fluid to said annular piston at the other end thereof, means for supplying fluid to both ends of said working piston, said annular piston being operatively connected to said element and adapted to displace fluid from said first cylinder chamber in response to a movement of said die and holder in said first direction and to supply the fluid thus displaced to said working cylinder to displace it in said second direction, the improvement residing in that said cylinder housing contains a second cylinder chamber, which is defined by said working piston at one end thereof and is adapted to communicate with said first cylinder chamber and to be supplied with pressure fluid for displacing said working piston in said second direction, a plurality of flow paths are provided, which are adapted to be selectively enabled to control the communication between said first and second cylinder chambers and which differ in hydraulic characteristics and are adapted to establish different pressures in said second cylinder chamber in response to the detection of a give pressure in said second cylinder chamber, a pressure detector is provided for detecting the pressure in either of said first and second cylinder chamber and for generating a control signal in response to a rise of said pressure above a predetermined value, and selector means are provided for enabling another of said flow paths in response to said control signal.

2. The improvement set forth in claim 1, wherein first, second and third of said flow paths are provided, said pressure detector is adapted to generate a first control signal in response to a rise of said pressure above a first predetermined value and to generate a second control signal in response to a rise of said pressure above a second predetermined value, and said selector means are arranged to enable said second flow path in response to said first control signal and to enable said third flow path in response to said second control signal.

3. The improvement set forth in claim 2, wherein said selector means comprise a directional valve, which is operable to connect said first cylinder chamber to said second cylinder chamber via each of said first, second and third flow paths in response to said control signal from said pressure detector.

4. The improvement set forth in claim 3, wherein said first flow path directly connects said directional valve to said second cylinder chamber, said second flow path connects said directional valve to said second cylinder chamber and contains a controllable pressure relief valve, which is adapted to be set to different pressure limits and is preceded by a check valve, and said third flow path contains a second directional valve, a throttle valve and a piston-type pressure accumulator, which constitutes a hydraulic pressure transformer.

5. The improvement set forth in claim 4, wherein a by-pass line is provided, which is adapted to by-pass said second directional valve and said throttle valve and contains a check valve for permitting a flow through said by-pass line toward said second cylinder chamber in response to a rise of said pressure above a predetermined value.

6. The improvement set forth in claim 1, wherein said hydraulic element comprises said cylinder housing which includes a cylinder and has a bottom, a tubular partition extends in said housing from said bottom and hydraulically separates said first and second cylinder chambers from each other, said annular piston is guided by said cylinder and is provided with a radial flange, which bridges said tubular partition and is guided on said working piston, and said annular piston has an inside peripheral surface which is radially spaced from said tubular partition.

7. The improvement set forth in claim 1, wherein said working piston is pot-shaped and has a bottom at that end of said working piston which is opposite to said second cylinder chamber, said working piston defines a central cavity, said cylinder contains a third cylinder chamber, which is contained in said cavity and defined by said bottom of said working piston, said third cylinder chamber is adapted to be supplied with pressure fluid for displacing said working piston in said first direction, a central stationary piston is anchored in said bottom of said cylinder housing, a ring is connected to said working piston, said third cylinder chamber is also defined by said central piston and by said ring, and said cylinder contains a fourth cylinder chamber, which communicates with said second cylinder chamber and is defined by said bottom of said working piston and by said central piston.

8. The improvement set forth in claim 7, wherein said second and third cylinder chambers are connected by a line which contains a directional valve and is adapted to supply fluid from said third to said second cylinder chamber, a main pressure accumulator is provided for supplying fluid to said third cylinder chamber to move said working piston in said first direction, and a fluid reservoir is provided for receiving pressure fluid from said first and second cylinder chambers in a volume which equals the volume of said third cylinder chamber in response to a supply of fluid from said main pressure accumulator to said third cylinder chamber.

9. The improvement set forth in claim 8, wherein said third flow path contains a piston-type pressure accumulator having an input cylinder chamber that is connected to said first cylinder chamber, an output cylinder chamber that is connected to said second cylinder chamber and a piston separating said input and output chambers, said main pressure accumulator is adapted to be connected to said first, second, third and fourth cylinder chambers, said output cylinder chamber is connected to a line that contains a directional valve for connecting said line to said main pressure accumulator, and a feed pump is provided for charging said main pressure accumulator with fluid from said fluid reservoir.

10. The improvement set forth in claim 7, wherein a pressure source is provided for supplying fluid to said second cylinder chamber, a fluid reservoir is connected to said third cylinder chamber by a line for conducting fluid which is displaced from said third cylinder chamber to said fluid reservoir and said line contains a directional valve.

11. The improvement set forth in claim 1, wherein a severing cutter for severing the completely drawn part from the remainder of the blank is mounted in said blank holder for a limited displacement, a unit consisting of said drawing die, said blank holder and said annular piston is movable in said first direction to sever said part from the remainder of said blank, the completion of said severing is adapted to result in a pressure drop in said first cylinder chamber because the resistance of said blank to being severed has been eliminated, a main pressure accumulator is provided, which is adapted to receive fluid from said first cylinder chamber via said third flow path and said third flow path contains a throttle valve for throttling the flow of fluid from said first cylinder chamber to said main pressure accumulator, and said throttle valve is adapted to throttle the flow in said third flow path in response to said pressure drop.

12. The improvement set forth in claim 11, wherein said third flow path contains a third directional valve for selectively connecting said third flow path to said second cylinder chamber and a fourth directional valve is provided for selectively connecting said third flow path to said main pressure accumulator.

* * * * *